US008157259B2

(12) United States Patent
Iizuka

(10) Patent No.: US 8,157,259 B2
(45) Date of Patent: Apr. 17, 2012

(54) MOVABLE TRAY DRIVE CONTROL DEVICE AND MOVABLE TRAY DRIVE CONTROL METHOD

(75) Inventor: Chiaki Iizuka, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/850,479

(22) Filed: Aug. 4, 2010

(65) Prior Publication Data

US 2011/0031678 A1 Feb. 10, 2011

Related U.S. Application Data

(60) Provisional application No. 61/231,169, filed on Aug. 4, 2009.

(51) Int. Cl.
*B65H 31/04* (2006.01)

(52) U.S. Cl. ..... 271/213; 271/214; 271/217

(58) Field of Classification Search ..... 271/213, 271/214, 215, 217; 399/405; 414/794.6
See application file for complete search history.

(56) References Cited

U.S. PATENT DOCUMENTS

| | | | | |
|---|---|---|---|---|
| 6,986,511 | B2 * | 1/2006 | Yamada et al. | 271/294 |
| 7,487,964 | B2 * | 2/2009 | Suzuki et al. | 271/176 |
| 7,954,809 | B2 * | 6/2011 | Kotani | 271/217 |
| 2007/0126174 | A1 * | 6/2007 | Kayama et al. | 271/215 |
| 2009/0057976 | A1 | 3/2009 | Iizuka | |

FOREIGN PATENT DOCUMENTS

| | | | |
|---|---|---|---|
| JP | 11343058 | A | 12/1999 |
| JP | 200340512 | A | 2/2003 |

* cited by examiner

*Primary Examiner* — David H Bollinger
(74) *Attorney, Agent, or Firm* — Patterson & Sheridan, LLP

(57) ABSTRACT

According to an embodiment, a drive control unit which drive-controls a movable tray on which a sheet discharged from a predetermined sheet discharge port is stacked, in such a manner that the movable tray sequentially descends according to a sheet discharge operation; an arrival position acquisition unit which acquires, in predetermined timing, arrival position information indicating an actual arrival position of the movable tray when the movable tray is drive-controlled by the drive control unit using a predetermined lower limit position as a target position; a fullness setting unit which sets a full position in the sheet stacking, of the movable tray, on the basis of the arrival position information acquired by the arrival position acquisition unit; and a fullness notification unit which gives a notification that the movable tray is full according to the arrival of the movable tray at the full position, are provided.

14 Claims, 9 Drawing Sheets

MOVABLE TRAY DRIVE CONTROL DEVICE AND MOVABLE TRAY DRIVE CONTROL METHOD

CROSS-REFERENCE TO RELATED APPLICATION(S)

This application is based upon and claims the benefit of priority from: U.S. provisional application 61/231,169, filed on Aug. 4, 2009; the entire contents all of which are incorporated herein by reference.

FIELD

Embodiments described herein relate generally to a technique of avoiding the occurrence of an error in a movable tray on which discharged sheets are stacked.

BACKGROUND

Conventionally, a movable tray on which sheets discharged from a sheet discharge port of an image forming apparatus body or finisher are stacked is known. The movable tray sequentially descends according to the number of sheets discharged from the sheet discharge port and moves downward to a predetermined lower limit position so that the quantity of sheets stacked on the movable tray reaches the maximum.

However, when an object such as luggage that prevents the descent of the movable tray exists below the movable tray, the downward movement of the movable tray may become disturbed by the luggage and the movable tray may not be able to move to the predetermined lower limit position.

As the movement of the movable tray is thus disturbed, an error occurs and the discharge of sheets is suspended.

Then, the discharge of sheets cannot be resumed until the luggage or the like causing the occurrence of the error is eliminated from below the movable tray.

DETAILED DESCRIPTION

Hereinafter, embodiments will be described with reference to the drawings.

In general, according to an embodiment, a movable tray drive control device includes a drive control unit, an arrival position acquisition unit, a fullness setting unit, and a fullness notification unit. The drive control unit drive-controls a movable tray on which a sheet discharged from a predetermined sheet discharge port is stacked, in such a manner that the movable tray sequentially descends according to a sheet discharge operation. The arrival position acquisition unit acquires, in predetermined timing, arrival position information indicating an actual arrival position of the movable tray when the movable tray is drive-controlled by the drive control unit using a predetermined lower limit position as a target position. The fullness setting unit sets a full position in the sheet stacking, of the movable tray, on the basis of the arrival position information acquired by the arrival position acquisition unit. The fullness notification unit gives a notification that the movable tray is full according to the arrival of the movable tray at the full position.

First Embodiment

Figure 1:
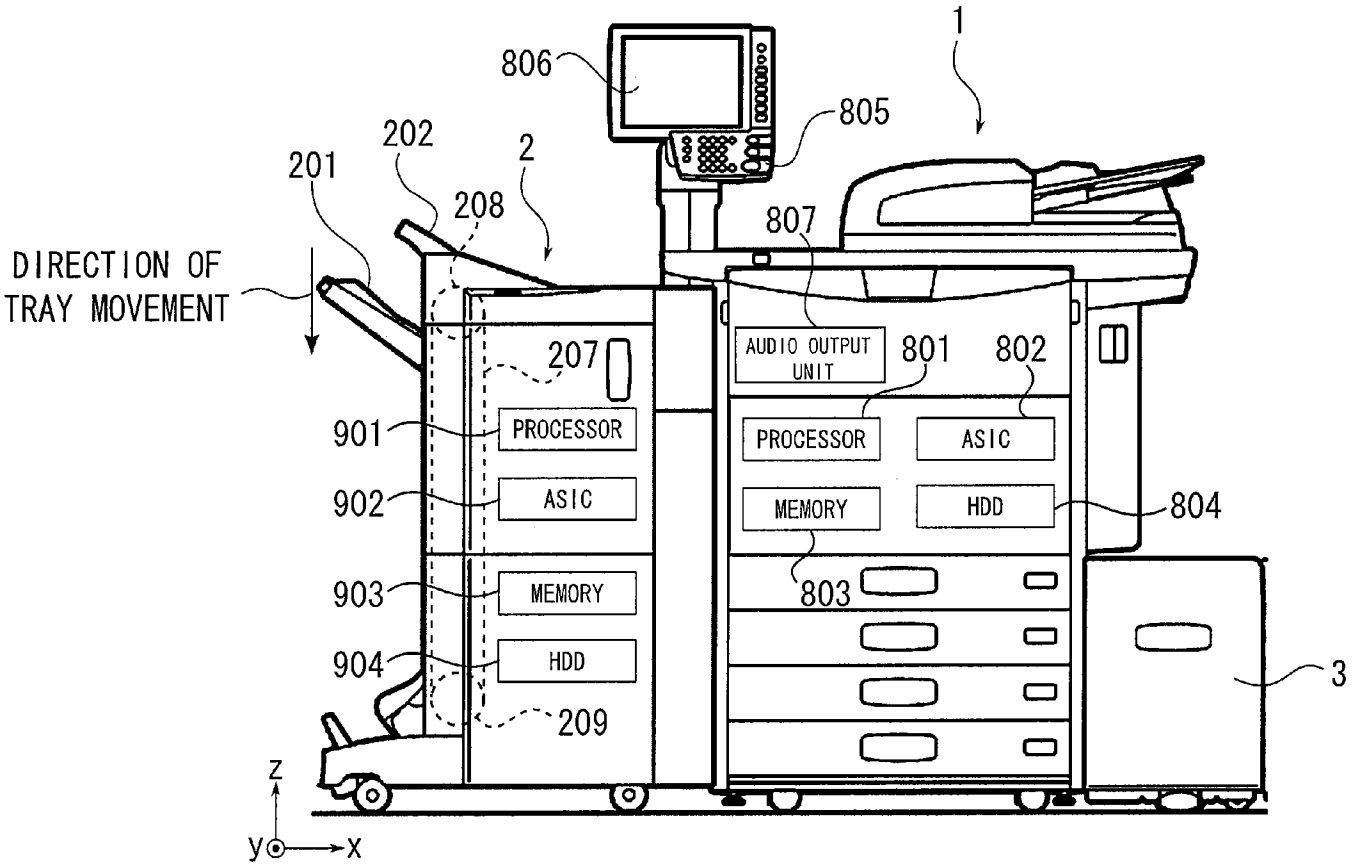
FIG. 1 is a schematic configuration view for explaining an image processing system according to a first embodiment of the invention.

FIG. 1 is a schematic configuration view for explaining an image processing system (MFP: multi-function peripheral) according to a first embodiment of the invention.

Figure 2:
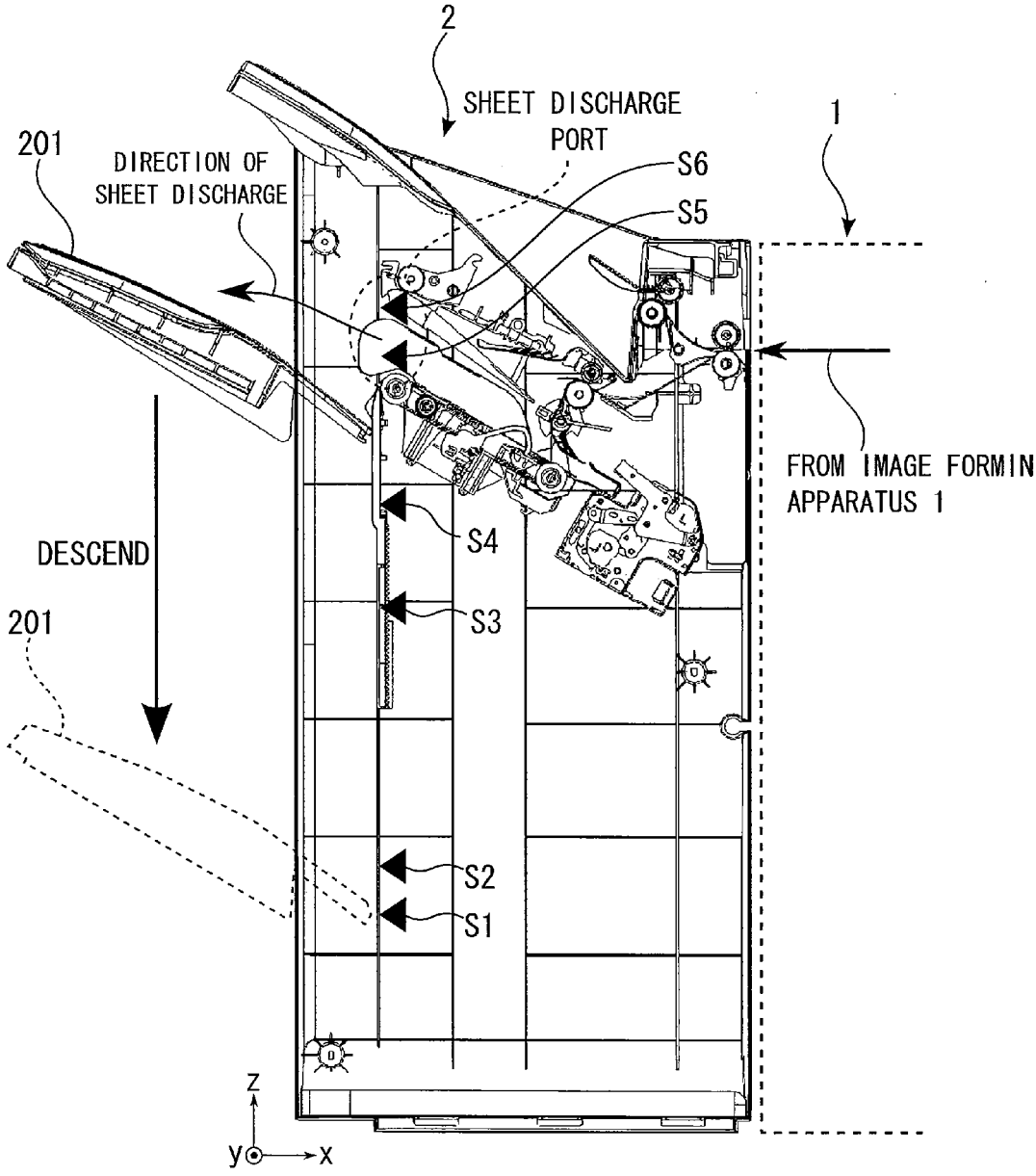
FIG. 2 is a longitudinal sectional view showing the schematic inner configuration of a finisher 2.

As shown in FIG. 1, the image processing system according to the first embodiment of the invention includes an image forming apparatus 1, a finisher 2, a large-capacity paper supply device 3, an operation input unit 805, and a display unit 806. FIG. 2 is a longitudinal sectional view showing the schematic inner configuration of the finisher 2.

The image forming apparatus 1 forms an image on a sheet on the basis of image data acquired by scanning an original or image data received via a network.

The large-capacity paper supply device 3 can supply a large number of sheets (for example, several thousand sheets) as recording media to the image forming apparatus 1

The finisher 2 performs predetermined finishing on a sheet on which an image is formed by the image forming apparatus 1. Specifically, the finisher 2 performs so-called "finishing" including stapling, folding, punching, and bookbinding, and discharges the finished sheet, for example, onto a movable tray 201.

The operation input unit 805 can include, for example, a keyboard, mouse, touch panel, touchpad, graphics tablet, dedicated button or the like.

The display unit 806 can include, for example, an electronic paper, LCD (liquid crystal display), EL (electronic luminescence), PDP (plasma display panel), CRT (cathode ray tube) or the like.

The functions of the operation input unit 805 and the display unit 806 can also be realized by a so-called touch panel display.

The image forming apparatus 1 has a processor 801, an ASIC (application specific integrated circuit) 802, a memory 803, an HDD (hard disk drive) 804, and a speaker 807.

The finisher 2 has a processor 901, an ASIC (application specific integrated circuit) 902, a memory 903, and an HDD (hard disk drive) 904.

In the image processing system according to this embodiment, the processor 801 and the processor 901 play the role of performing various kinds of processing in the image processing system and also play the role of realizing various functions by executing programs stored in the memory 803, the memory 903, the HDD 804, the HDD 904 or the like. As a matter of course, the processor 801 and the processor 901 can also be realized by CPUs (central processing units) or MPUs (micro processing units) capable of executing equivalent arithmetic processing. Similarly, the HDD 804 and the HDD 904 can be replaced by storage devices, for example, flash memories.

The memory 803 and the memory 904 can include, for example, a RAM (random access memory), ROM (read only memory), DRAM (dynamic random access memory), SRAM (static random access memory), VRAM (video RAM), flash memory or the like, and play the role of storing various kinds of information and programs used in the image processing system.

As shown in FIG. 1, the finisher 2 in this embodiment has a movable tray 201 that can move in up and down directions. The movable tray 201 has a sheet stacking surface on the top side. Sheets discharged from a predetermined sheet discharge port in the finisher 2 are sequentially stacked on the sheet stacking surface.

In the finisher 2, a pulley 209 is rotated by, for example, a stepping motor or the like, not shown, which is drive-controlled by the processor 801 or the processor 901. A belt 207 is wound over the pulley 209 and a pulley 208. The pulley 208 rotates following the rotational driving of the pulley 209. The movable tray 201 is connected to a part of the belt 207 and can move up and down with the turning of the belt 207.

The finisher 2 also has sensors S1 to S6 to detect the height position of the movable tray 201, which is moved up and down. The sensors S1 to S6 in this example are optical sensors. The sensors S1 to S6 according to this embodiment utilize the interruption of light from these optical sensors due to the movement of the movable tray 201 and thus detect the height position of the movable tray 201.

Specifically, the sensor S1 detects the movable tray 201 situated at a lower limit position within a mobility range. The sensor S2 detects the position of the movable tray 201 in the state where about 2,000 sheets are stacked on the sheet stacking surface of the movable tray 201. The sensor S3 detects the position of the movable tray 201 in the state where about 1,000 sheets are stacked on the sheet stacking surface of the movable tray 201. The sensor S4 detects the movable tray 201 situated at a home position. The sensor S5 detects an upper limit position within the mobility range of the movable tray 201.

Figure 3:
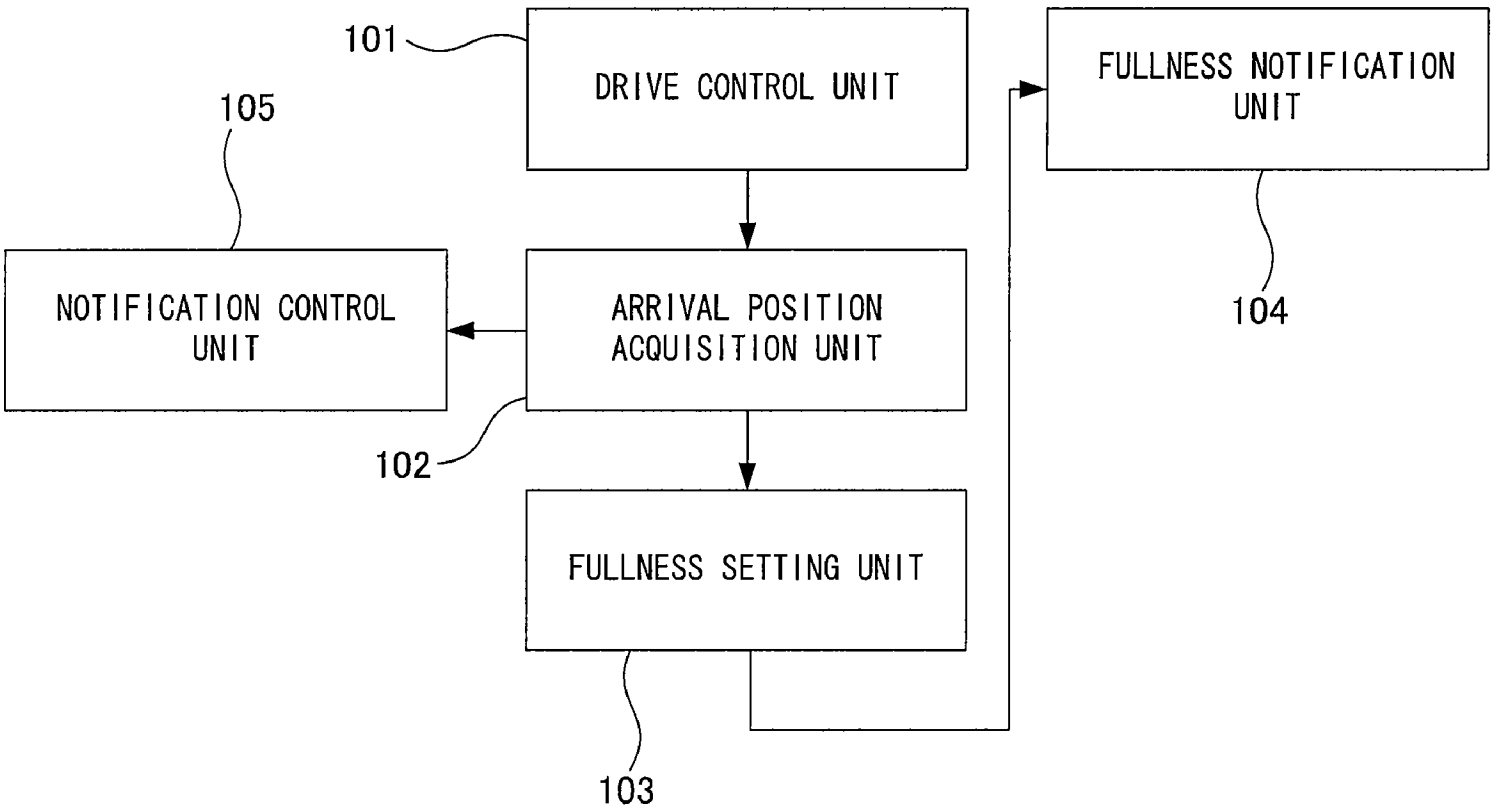
FIG. 3 is a functional block diagram showing a movable tray drive control device according to the embodiment.

FIG. 3 is a functional block diagram showing a movable tray drive control device according to this embodiment. Here, as an example, the finisher 2 is assumed to have each function of the movable tray drive control device.

The movable tray drive control device according to this embodiment has a drive control unit 101, an arrival position acquisition unit 102, a fullness setting unit 103, a fullness notification unit 104, and a notification control unit 105.

The drive control unit 101 drive-controls the movable tray 201 in such a manner that the movable tray 201 sequentially descends according to the discharge of sheets from the sheet discharge port.

Specifically, the drive control unit 101 sequentially causes the movable tray 201 to descent, for example, on the basis of the following information or the like:

(1) the number of sheets discharged from the image forming apparatus 1;

(2) the number of sheets discharged from the finisher 2; and (3) the number of sheets printed in the image forming apparatus 1.

The above information about the discharge of sheets can be acquired, for example, from the processor 801 and the processor 901. That is, as the number of sheets stacked on the sheet stacking surface of the movable tray 201 increases, the movable tray 201 moves further downward. Thus, the uppermost surface of the sheet bundle stacked on the movable tray 201 can be maintained constantly in a predetermined positional relation with the sheet discharge port that is suitable for the sheet discharge.

The drive control unit 101 causes "mechanical initialization" to be carried out to confirm whether the movable tray 201 is capable of executing an operation within a predetermined operation range or not, as an initialization in the startup or the like of the finisher 2.

The arrival position acquisition unit 102 acquires, in predetermined timing, "arrival position information" indicating the actual arrival position of the movable tray 201 when the movable tray 201 is drive-controlled by the drive control unit 101 using the predetermined lower limit position (the position detected by the sensor S1) as a target position.

The fullness setting unit 103 sets a full position in the sheet discharge, of the movable tray 201, on the basis of the "arrival position information" acquired by the arrival position acquisition unit 102.

The fullness notification unit 104 gives a notification of a "full state" according to the arrival of the movable tray 201 at the fullness position.

Here, "according to the arrival . . . at the full position" refers not only to a notification in the state where the movable tray 201 actually is at the full position, but also to a notification in the state where the movable tray 201 will arrive soon. That is, it suffices to be able to notify that no more sheets can be stacked on the movable tray 201, in appropriate timing.

The fullness setting unit 103 desirably sets a height position that is higher by a predetermined height (for example, 1 cm or more) than the tray position indicated by the "arrival position information" acquired by the arrival position acquisition unit 102, as the full position. Specifically, the fullness setting unit 103 stores the set value of the full position, for example, in the memory 803, the HDD 804 or the like.

In this manner, a slightly higher position than the position that is actually reached by the movable tray 201 is thus set as the full position, instead of setting the position that is actually reached by the movable tray 201 as the full position. Thus, the movable tray 201 can be prevented from colliding with an obstacle every time the maximum amount of sheets is stacked on the movable tray 201.

Here, the "predetermined timing" may be the following, for example:

(1) in the mechanical initialization when power is turned on in the finisher 2 (the movable tray drive control device);

(2) in the mechanical initialization when the finisher 2 (the movable tray drive control device) is started up (restored) from a "power-saving mode", "sleep mode", or "super-sleep mode"; and (3) in the mechanical initialization at the startup after a sheet jam is solved in the image forming apparatus.

The notification control unit 105 causes a notification to be given that the obstacle below the movable tray 201 should be eliminated when the tray position indicated by the "arrival position information" acquired by the arrival position acquisition unit 102 is equal to or higher than a predetermined height. The notification in this case may be, for example, a notification via a screen display on the display unit 806.

Figure 4:
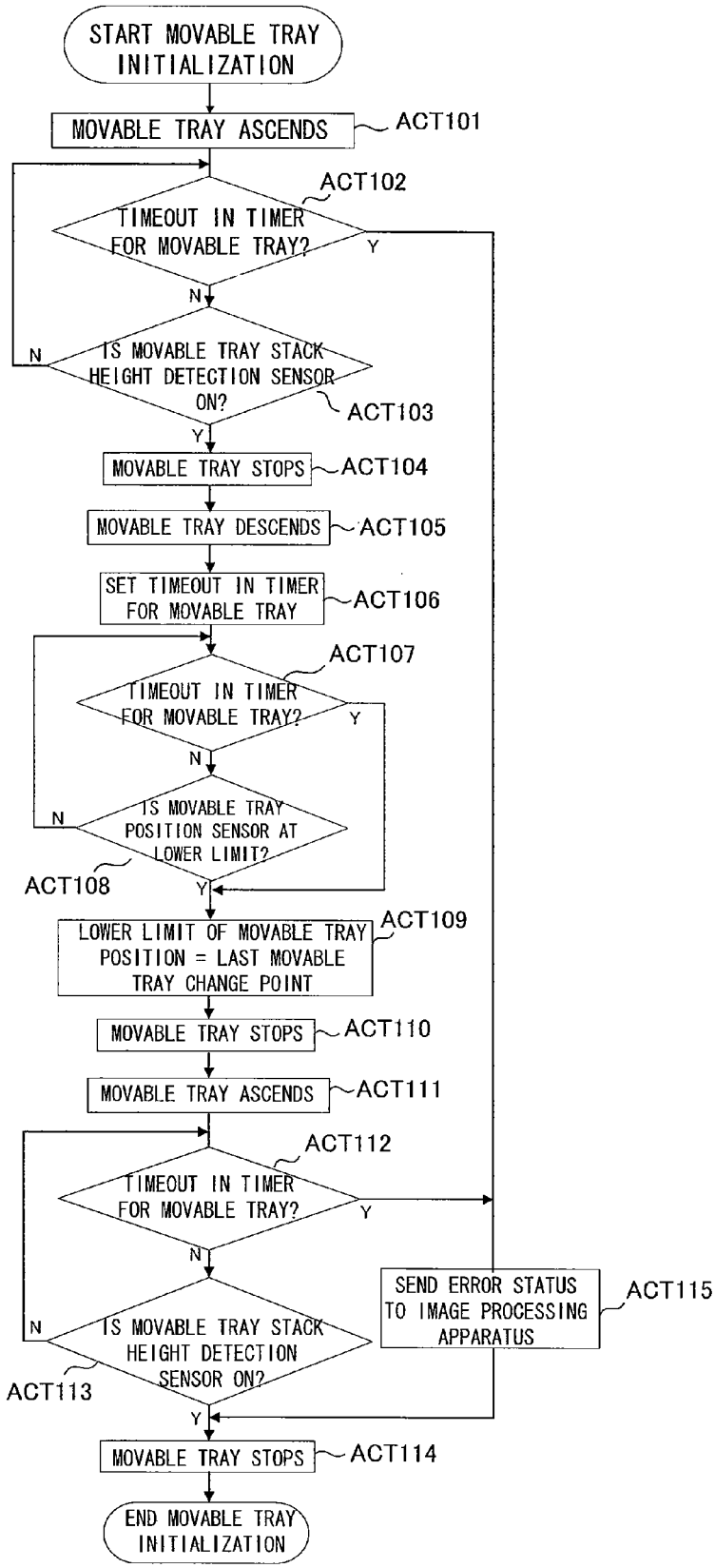
FIG. 4 is a flowchart for explaining the flow of processing in the finisher 2 (moveable tray drive control device).

FIG. 4 is a flowchart for explaining the flow of processing in the finisher 2 (the movable tray drive control device).

When the initialization of the movable tray 201 is started, the drive control unit 101 causes the movable tray 201 to ascend until the sensor S6 detects the movable tray 201 (ACT 101, ACT 102).

When the movable tray 201 is detected by the sensor S6 (ACT 103, Y), the drive control unit 101 stops the ascent of the movable tray 201 (ACT 104).

Subsequently, the drive control unit 101 starts the descent of the movable tray 201 (ACT 105) and sets a timeout value in a timer for the movable tray (ACT 106).

The drive control unit 101 causes the movable tray 201 to descend, using the lower limit position where the movable tray 201 is detected by the sensor S1, as a target position (ACT 108).

The arrival position acquisition unit 102 acquires arrival position information indicating the actual arrival position of the movable tray 201 (the sensor which detects the movable tray 201 lastly) (ACT 109).

Figure 5:
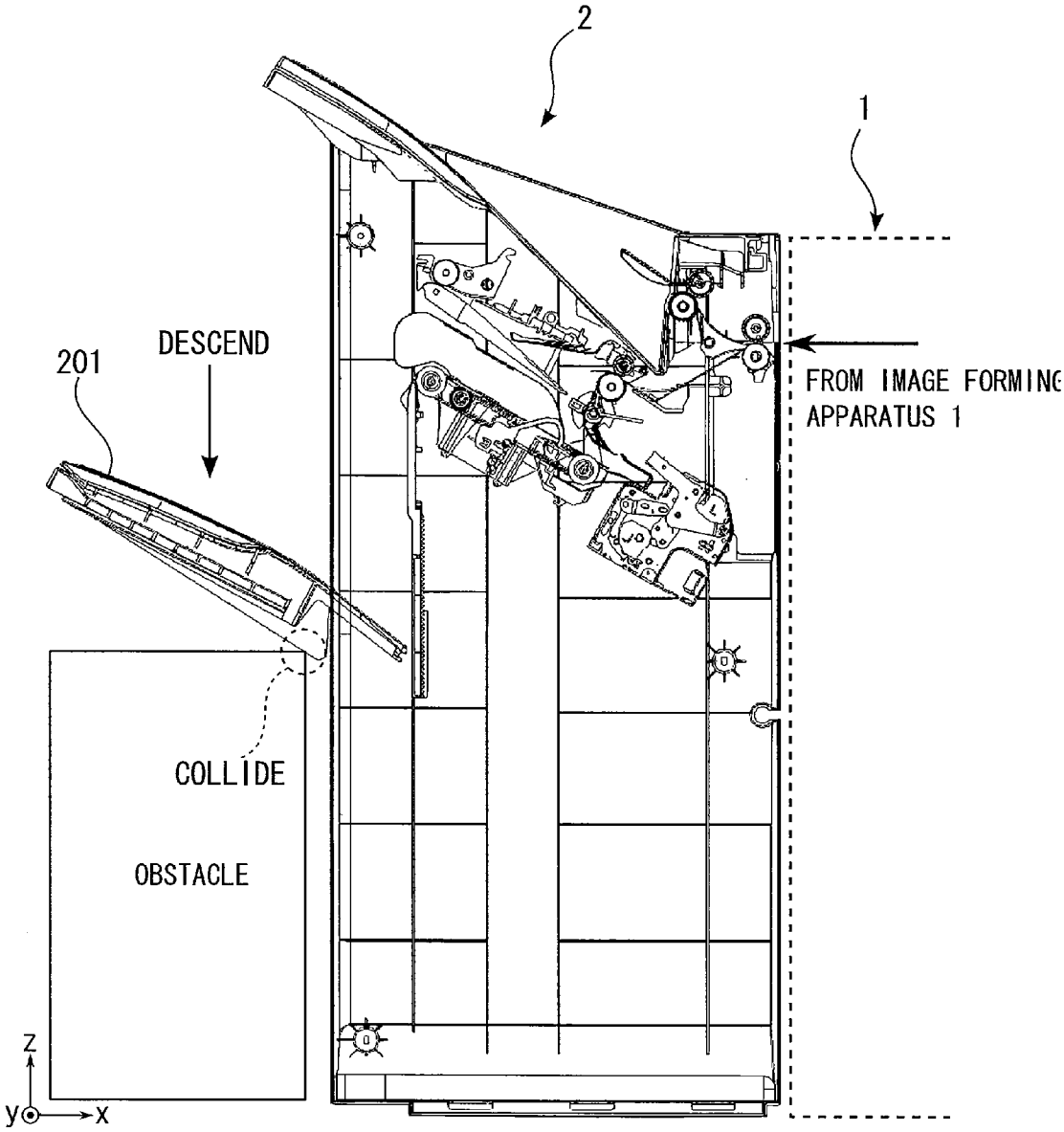
FIG. 5 is a conceptual view showing the state where an object such as luggage that becomes an obstacle is placed within the mobility range of a movable tray 201.

Specifically, when an object such as luggage which becomes an obstacle is placed below the movable tray 201 and within the mobility range of the movable tray 201, for example, as shown in FIG. 5, the movable tray 201 collides with the obstacle and cannot move up any longer. Such a position of the movable tray that is below the target position but is lowered only to a certain extent because of the influence of the obstacle or the like is equivalent to the actual arrival position as well.

The drive control unit 101 stops the descent of the movable tray 201 (ACT 110) and causes the movable tray 201 to ascend (ACT 111).

The drive control unit 101 causes the movable tray 201 to ascend until the sensor S6 detects the movable tray 201 (ACT 112, ACT 113).

When the movable tray 201 is detected by the sensor S6, the drive control unit 101 stops the movable tray 201 (ACT 114).

Meanwhile, when the timeout value in the timer for the movable tray 201 is exceeded in ACT 102 and ACT 112, the drive control unit 101 sends an error status (ACT 115).

Each operation during the processing in the movable tray drive control device is realized by causing the processor 801 or the processor 901 to execute a movable tray drive control program stored in the memory 803 or the memory 903.

In this way, according to this embodiment, even the case where the user places an object such as luggage below the movable tray 201 and the movable tray 201 cannot move within the designed mobility range, is not treated as an error. Thus, the user can continue printing simply by removing sheets stacked on the movable tray 201 without having to carry out jam solution.

Moreover, the full position is decided on the basis of the mobility range of the movable tray in the timing of the mechanical initialization. Therefore, for example, when the user eliminates the obstacle, the full position is updated to a normal position in the next mechanical initialization.

Second Embodiment

Next, a second embodiment will be described.

The second embodiment is a modification of the above first embodiment. Hereinafter, elements having similar functions to units that are already described in the first embodiment are denoted by the same reference numerals and will not be described further in detail.

Figure 6:
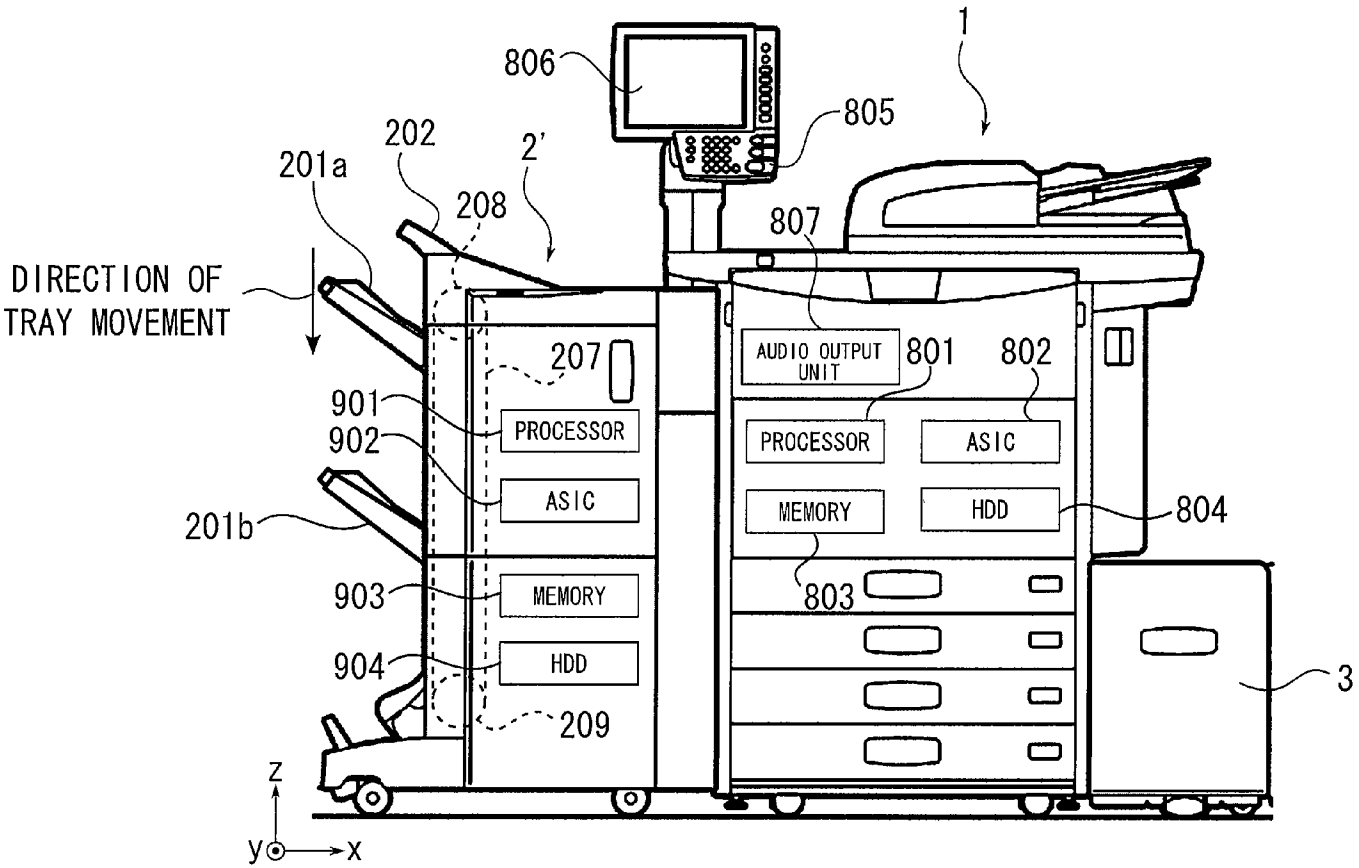
FIG. 6 is a system configuration view showing the outline of an image processing system according to a second embodiment.
Figure 7:
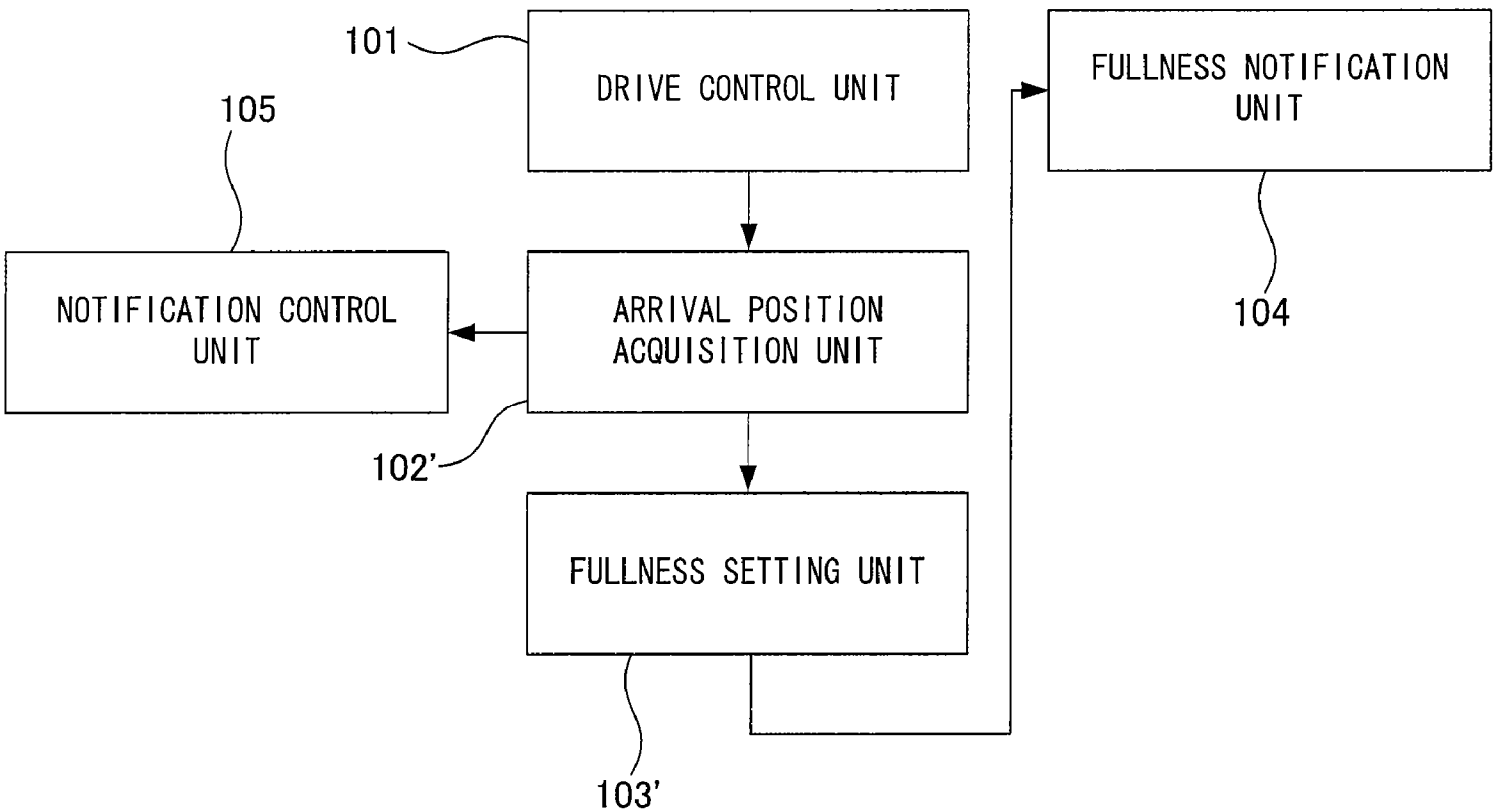
FIG. 7 is a functional block diagram showing a movable tray drive control device according to the second embodiment.

FIG. 6 is a system configuration view showing the outline of an image processing system according to the second embodiment. FIG. 7 is a functional block diagram showing a movable tray drive control device according to the second embodiment.

In the first embodiment, the configuration in which one movable tray is provided in a finisher is described. However, the possible configuration is not limited to the first embodiment. For example, as in a finisher 2' shown in FIG. 6, a configuration including a first movable tray 201*a* and a second movable tray 201*b* can also be employed.

In the second embodiment, the second movable tray 201*b* is situated below the first movable tray 201*a*. The first movable tray 201*a* and the second movable tray 201*b* can move up and down independently of each other.

An arrival position acquisition unit 102' acquires, in predetermined timing, "arrival position information" indicating the actual arrival position of the second movable tray 201*b* when the second movable tray 201*b* is drive-controlled by the drive control unit 101 using a predetermined lower limit position as a target position.

In the configuration including the movable trays arranged vertically in two stages as in this embodiment, when the movement range of the lower movable tray 201*b* is limited by an obstacle that is situated below, the movement range of the upper movable tray 201*a* is influenced as well.

Thus, a fullness setting unit 103' in this embodiment sets a full position in sheet stacking, of the first movable tray 201*a* and the second movable tray 201*b*, on the basis of the "arrival position information" acquired by the arrival position acquisition unit 102'.

Third Embodiment

Next, a third embodiment will be described.

The third embodiment is a modification of the above embodiments. Hereinafter, elements having similar functions to units that are already described in the embodiments are denoted by the same reference numerals and will not be described further in detail.

Figure 8:
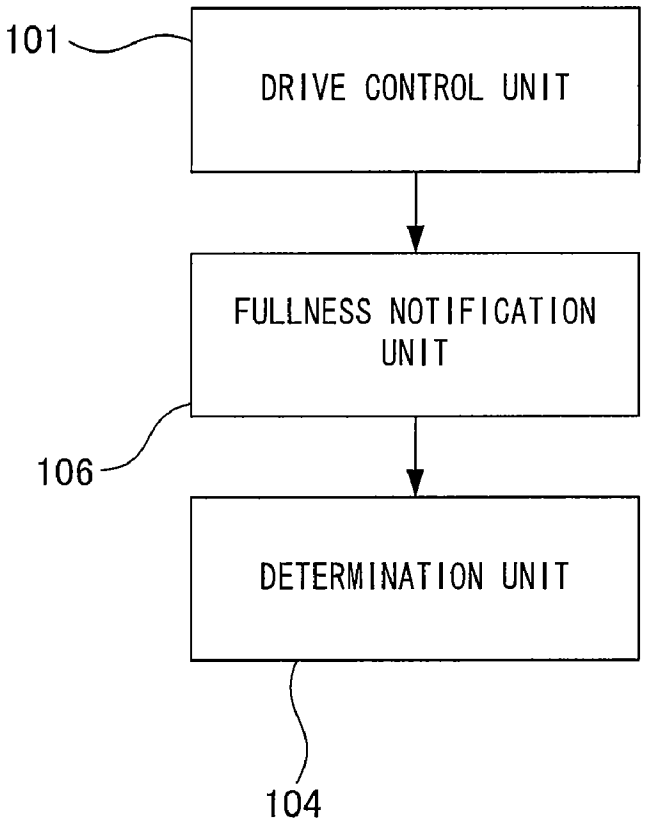
FIG. 8 is a functional block diagram showing a movable tray drive control device according to a third embodiment.

FIG. 8 is a functional block diagram showing a movable tray drive control device according to the third embodiment.

In this embodiment, the movable tray drive control device includes a determination unit 106 which determines whether the movable tray is lowered to the target position or not, when the movable tray is drive-controlled by the drive control unit 101 in such a manner that the movable tray is lowered to the target position, and a fullness notification unit 104 which gives a notification that the movable tray is full, when it is determined by the determination unit 106 that the movable tray cannot be lowered to the target position.

Figure 9:
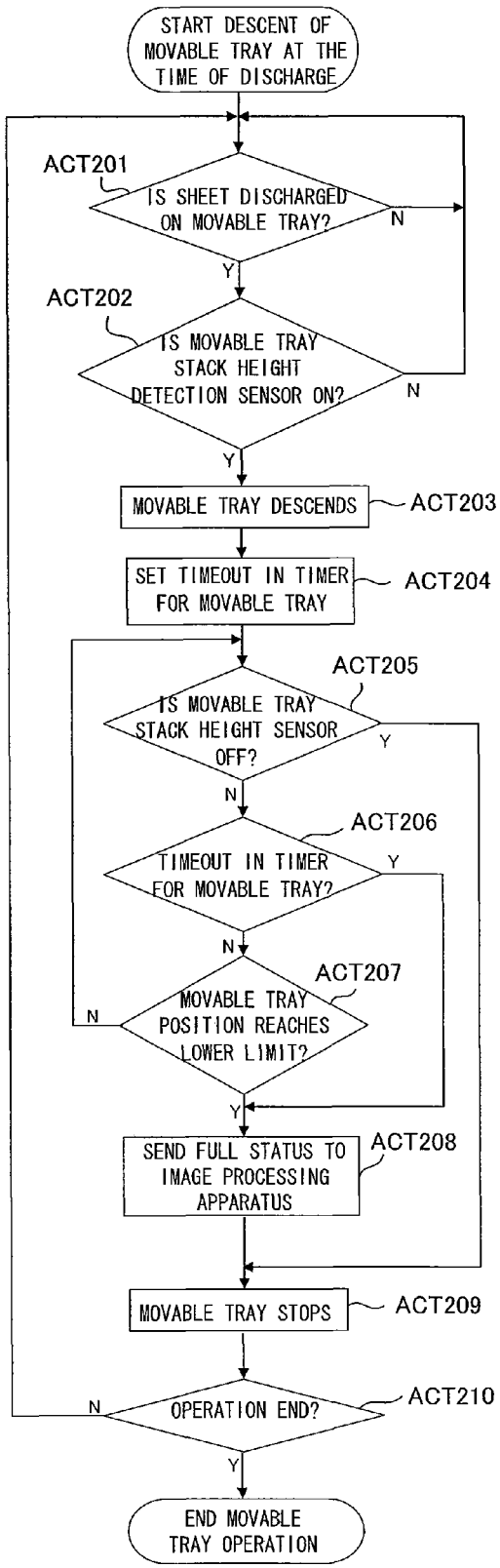
FIG. 9 is a flowchart showing the flow of processing in the movable tray drive control device according to the third embodiment.

FIG. 9 is a flowchart showing the flow of processing in the movable tray drive control device according to the third embodiment.

When it is determined that a sheet is discharged onto the movable tray 201 (ACT 201, Y) and the movable tray 201 is detected by a sensor which detects the quantity of stacked sheets on the movable tray 201, such as the sensor S2 or the sensor S3 (ACT 202, Y), the drive control unit 101 causes the movable tray 201 to descend (ACT 203).

The drive control unit 101 sets a timeout value in the timer for the movable tray 201 (ACT 204).

When the movable tray 201 is not detected by the sensor S1 (the lower limit position sensor) and the movable tray 201 is not detected by the sensor S2, the sensor S3 or the like even when the predetermined timeout value is exceeded, the determination unit 106 determines that the movable tray 201 cannot descend because of an obstacle or the like. Then, a notification that the movable tray 201 is full is given (ACT 208) and the driving of the movable tray 201 by the drive control unit 101 is stopped (ACT 209).

In the above embodiments, the configuration is described in which the position of the movable tray in the vertical direction is detected by the optical sensors S1 to S6. However, the detection of the position is not limited to this configuration. For example, the position of the movable tray 201 can be detected on the basis of the quantity of driving of a motor or the like, for example, by using an encoder. As the encoder is used in this manner, the accuracy of the position detection of the movable tray 201 is enhanced and more accurate drive control of the movable tray can be carried out.

In the above embodiments, the configuration is described in which all the functions constituting the movable tray drive control device are provided in the finisher 2. However, the configuration is not limited to these embodiments. For example, a part or all of the functions constituting the movable tray drive control device may be provided on the image forming apparatus side. That is, the location of each function is not particularly specified as long as all the functions of the movable tray drive control device can be consequently realized in the system as a whole.

Moreover, the program which causes the computer constituting the movable tray drive control device to execute each of the above operations can be provided as a movable tray drive control program. In the embodiments, the case where the program to realize the functions that embody the invention is recorded in advance in a storage area provided within the device, is described as an example. However, the provision of the program is not limited to the embodiment. A similar program may be downloaded to the device from a network. Alternatively, a similar program stored in a computer-readable recording medium may be installed in the device. The recording medium may be in any form as long as the recording medium can store a program and can be read by a computer. Specifically, the recording medium may be, for example, an internal storage medium mounted in the computer such as a ROM or RAM, a portable storage medium such as CD-ROM, flexible disk, DVD disk, magneto-optical disk or IC card, a database which holds a computer program, another computer and its database, a transmission medium on a channel, or the like. The functions thus acquired in advance by installing or downloading may be realized in cooperation with the OS (operating system) or the like within the device.

A part of or the entirety of the program may be dynamically generated execution modules.

As a matter of course, at least a part of the various kinds of processing realized by causing the processor to execute the program in the embodiments can be executed in a circuit-like matter by the ASIC 802 or the ASIC 902.

As described above in detail, according to the technique described in this specification, a technique of avoiding the occurrence of an error in a movable tray on which discharged sheets are stacked can be provided.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the sprit of the inventions. The accompanying claims and their equivalents are intended to cover such forms or modifications as would fall within the scope and spirit of the inventions.

What is claimed is:

1. A device comprising:

a movable tray configured to stack a sheet discharged from a predetermined sheet discharge port, the movable tray being configured to descend to a predetermined lower limit position as a target position at a predetermined time;

an arrival position acquisition unit configured to acquire arrival position information indicating an actual arrival position where the movable tray stops before the movable tray arrives at the predetermined lower limit position;

a fullness setting unit configured to set a full position in the sheet stacking, of the movable tray, on the basis of the arrival position information acquired by the arrival position acquisition unit;

a drive control unit configured to cause the movable tray to descend toward the predetermined lower limit position at the predetermined time and configured to cause the movable tray to ascend to a predetermined upper position after the movable tray stops at the actual arrival position; and a fullness notification unit configured to give a notification that the movable tray is full if the movable tray arrives at the full position, after the fullness setting unit sets the full position and the drive control unit causes the movable tray to ascend to the predetermined upper position.

2. The device of claim 1, wherein the fullness setting unit sets a position that is higher by a predetermined height than a tray position indicated by the arrival position information acquired by the arrival position acquisition unit, as the full position.

3. The device of claim 1, wherein the predetermined time is the time of mechanical initialization when power is turned on in the movable tray drive control device.

4. The device of claim 1, wherein the predetermined time is the time of mechanical initialization when the movable tray drive control device is started up from a power-saving mode.

5. The device of claim 1, wherein the movable tray is for stacking a sheet discharged from an image forming apparatus which forms an image on the sheet, and the predetermined time is the time of mechanical initialization at startup after a sheet jam is solved in the image forming apparatus.

6. The device of claim 1, further comprising a notification control unit which causes a notification to be given that an obstacle below the movable tray should be eliminated when a tray position indicated by the arrival position information acquired by the arrival position acquisition unit is equal to or higher than a predetermined height.

7. The device of claim 1, wherein the movable tray includes a first movable tray, and a second movable tray which is situated below the first movable tray and can move up and down independently of the first movable tray, the arrival position acquisition unit acquires, in the predetermined time, arrival position information indicating an actual arrival position of the second movable tray when the second movable tray is drive-controlled by the drive control unit using a predetermined lower limit position as a target position, and the fullness setting unit sets a full position in sheet stacking, of the first and second movable trays, on the basis of the arrival position information acquired by the arrival position acquisition unit.

8. A movable tray drive control method in a movable tray drive control device which drive-controls a movable tray on which a sheet discharged from a predetermined sheet discharge port is stacked, in such a manner that the movable tray sequentially descends according to a sheet discharge operation, the method comprising:

causing the movable tray to descend toward a predetermined lower limit position as a target position at a predetermined time;

acquiring arrival position information indicating an actual arrival position where the movable tray stops before the movable tray reaches the predetermined lower limit position;

setting a full position in the sheet stacking, of the movable tray, on the basis of the acquired arrival position information;

causing the movable tray to ascend to a predetermined upper position after the movable tray stops at the actual arrival position; and giving a notification that the movable tray is full if the movable tray arrives at the full position as the movable tray ascends to the predetermined upper position.

9. The method of claim 8, wherein a position that is higher by a predetermined height than a tray position indicated by the acquired arrival position information is set as the full position.

10. The method of claim 8, wherein the predetermined time is the time of mechanical initialization when power is turned on in the movable tray drive control device.

11. The method of claim 8, wherein the predetermined time is the time of mechanical initialization when the movable tray drive control device is started up from a power-saving mode.

12. The method of claim 8, wherein the movable tray is for stacking a sheet discharged from an image forming apparatus which forms an image on the sheet, and the predetermined time is the time of mechanical initialization at startup after a sheet jam is solved in the image forming apparatus.

13. The method of claim 8, wherein a notification is given that an obstacle below the movable tray should be eliminated when a tray position indicated by the acquired arrival position information is equal to or higher than a predetermined height.

14. The method of claim 8, wherein the movable tray includes a first movable tray, and a second movable tray which is situated below the first movable tray and can move up and down independently of the first movable tray, and further comprising:

acquiring arrival position information indicating an actual arrival position of the second movable tray when the second movable tray is drive-controlled using a second predetermined lower limit position as a second target position, and wherein the setting the full position comprises setting a full position in sheet stacking, of the first and second movable trays, on the basis of the acquired arrival position information.

* * * * *